US007044053B2

(12) United States Patent
Figov et al.

(10) Patent No.: US 7,044,053 B2
(45) Date of Patent: May 16, 2006

(54) METHOD AND MATERIALS FOR IMPROVING RESOLUTION FOR CTP-INKJET

(75) Inventors: Murray Figov, Ra'anana (IL); Zohar Stern, Givatayim (IL)

(73) Assignee: Creo IL. Ltd., Herzlia Pituah (IL)

( * ) Notice: Subject to any disclaimer, the term of this patent is extended or adjusted under 35 U.S.C. 154(b) by 0 days.

(21) Appl. No.: 10/796,044

(22) Filed: Mar. 10, 2004

(65) Prior Publication Data

US 2005/0199149 A1 Sep. 15, 2005

(51) Int. Cl.
*B41F 9/00* (2006.01)
*B41M 5/00* (2006.01)

(52) U.S. Cl. ..... 101/154; 101/463.1; 101/465; 101/466

(58) Field of Classification Search ..... 101/154, 101/465, 466, 463.1
See application file for complete search history.

(56) References Cited

U.S. PATENT DOCUMENTS

| | | | | |
|---|---|---|---|---|
| 5,275,927 | A * | 1/1994 | Pham et al. | 430/536 |
| 5,501,150 | A * | 3/1996 | Leenders et al. | 101/466 |
| 5,820,932 | A * | 10/1998 | Hallman et al. | 427/261 |
| 6,014,929 | A * | 1/2000 | Teng | 101/456 |
| 6,132,938 | A * | 10/2000 | Yoshida et al. | 430/302 |
| 6,196,129 | B1 * | 3/2001 | Kellett | 101/467 |
| 6,357,351 | B1 * | 3/2002 | Bhambra et al. | 101/455 |
| 6,387,591 | B1 * | 5/2002 | Leenders et al. | 430/271.1 |
| 6,420,091 | B1 * | 7/2002 | Nakayama et al. | 430/302 |
| 6,490,975 | B1 * | 12/2002 | Rorke et al. | 101/467 |
| 6,497,178 | B1 * | 12/2002 | Rorke et al. | 101/457 |
| 6,598,526 | B1 * | 7/2003 | Rorke et al. | 101/457 |
| 6,634,295 | B1 * | 10/2003 | Newington et al. | 101/466 |
| 6,637,336 | B1 * | 10/2003 | Suda et al. | 101/465 |
| 2003/0061957 | A1 * | 4/2003 | Kasai | 101/463.1 |

FOREIGN PATENT DOCUMENTS

| | | |
|---|---|---|
| EP | 0503621 | 9/1992 |
| EP | 0533168 | 6/1998 |
| EP | 0697282 | 12/1998 |
| GB | 1431462 | 4/1976 |
| JP | 56-105960 | 8/1981 |
| WO | WO 00/37254 | 6/2000 |
| WO | WO 00/46036 | 8/2000 |
| WO | WO 00/76779 | 12/2000 |
| WO | WO 01/49506 | 7/2001 |
| WO | WO 2004/052647 | 6/2004 |

* cited by examiner

*Primary Examiner*—Andrew H. Hirshfeld
*Assistant Examiner*—Marvin P Crenshaw

(57) ABSTRACT

Improved resolution plates based on hydrophilic organic coated substrates, where a hydrophobic layer is present during inkjet imaging and where after heating to fuse the inkjet image, the hydrophobic layer does not irreversibly fuse into the organic coating, but can be removed by aqueous washing to restore the hydrophilic nature of the plate surface.

18 Claims, No Drawings

METHOD AND MATERIALS FOR IMPROVING RESOLUTION FOR CTP-INKJET

FIELD OF THE INVENTION

The present invention deals with offset lithographic printing plates produced by inkjet imaging.

BACKGROUND OF THE INVENTION

Offset lithographic printing has remained a most popular method of printing for many years. An important reason for this is the relative ease with which offset lithographic printing plates can be produced. Currently, the most widely used method for plate preparation is that which utilizes specially prepared masking films, through which pre-sensitized printing blanks are selectively hardened or softened (according to the chemistry of the plate) by exposure to ultra violet light. The plate then undergoes a development process, during which the more soluble regions of the coating on the plate are washed away. A detailed description of the system and the plates used can be found in Chapter 20 of the book "Printing Materials: Science and Technology" by Bob Thomson 1998, published by Pira.

Offset lithographic plates can be produced using inkjet printing. Inkjet is a non-impact printing process whereby ink is squirted through very fine nozzles and the resultant ink droplets form an image directly on a substrate. There are two main types of inkjet processes. In one process, usually termed continuous inkjet printing, a stream of ink drops are electrically charged and then are deflected by an electric field either directly or indirectly onto the substrate. The viscosity of inks used in such systems is typically 2 or 3 centipoises. In the second process, usually called Drop on Demand (DOD) inkjet printing, the ink supply is regulated by an actuator such as a piezoelectric actuator. The pressure produced during the actuation forces a droplet through a nozzle onto the substrate. Inks for DOD inkjet printing do not need to be conductive and their viscosity is typically between 2 and 40 centipoises.

The application of inkjet to produce printing plates is an idea that can be traced back to the origins of the inkjet process. In U.S. Pat. No. 2,512,743 assigned to the Radio Corporation of America, Clarence W. Hansell, the inventor of the DOD method described in this patent, wrote: "The invention may also be used for spraying acids and chemicals for etching of printing plates . . .". Although the general concept was disclosed here, no further details were given. U.S. Pat. No. 4,003,312 by Gunther details methods of inkjet offset lithographic platemaking, but the plate substrate is confined to silicone surfaces for driographic (waterless) printing which had been at that time recently invented (see U.S. Pat. No. 3,511,178—Curtin). UK Patent 1431462 describes the use of a continuous jet process to image a coated plate by hardening the coating with reactive ink. The unhardened background areas are then washed away. JP56105960-Nakayama et al. assigned to Fuji Photo Film (1981) includes the use of heat activated hardening material in oleophilic inkjet inks, forming the image areas on hydrophilic substrates. The substrate may or may not be coated.

Although the idea of plate making by inkjet has a long history, commercial success in the field has been limited by the lack of maturity of the inkjet process itself. Development of plate making followed the developments in inkjet. U.S. Pat. No. 4,833,486 by Zerillo (assigned to Dataproducts) utilizes a hydrophobic solid inkjet ink (containing waxes), which is held at a sufficiently high temperature to jet it through a DOD head. (This solid ink technology is more fully described in U.S. Pat. Nos. 4,390,369, 4,484,948 and 4,593,292). The substrate is a hydrophilic offset plate—either paper or aluminum—onto which the image is jetted. When the ink hits the plate it immediately cools and solidifies. One problem of such an approach is the difficulty in obtaining sufficiently good adhesion of the waxes of the ink to the plate to run multiple impressions during lithographic printing.

EP503621 (Applicant NIPPON PAINT CO) discloses two approaches. One approach describes jetting inks onto a pre-sensitized plate, which then needs further treatment, including a developing stage with a liquid developer. The other approach uses a non-pre-sensitized plate and the inkjet ink is photosensitive so that it can be hardened on the plate.

EP533168 by Nippon describes the use of photopolymeric-based inkjet ink together with an ink absorbing layer on the litho plate surface.

EP697282 by Leanders (Agfa) describes a two-component system, whereby one reactive component is in the ink and the other in the litho plate surface, so that when the ink hits the plate it produces an oleophilic reduced silver image that can be used in the offset printing process.

U.S. Pat. No. 5,495,803 by Gerber describes imaging a coated, pre-sensitized plate with a UV opaque hot melt inkjet ink and using the ink as a photo-mask to expose the plate. The unexposed pre-sensitized polymer and the ink are subsequently removed by washing.

U.S. Pat. No. 5,738,013 by Kellet describes an ink-jet plate-making process involving the use of reactive inkjet ink, which is bonded to the litho plate by a chemical reaction activated by radiant energy. This assumes that such inks have very good stability at room temperature, so that no jet blocking will occur, yet have good reactivity at high temperatures, so that the ink becomes insoluble with good adhesion to the offset plate and with good oleophilic properties.

Kato et al. utilize oil-based inks of a variety of types in plate formation (U.S. Pat. Nos. 6,106,984, 6,174,936, 6,184,267 and 6,197,847).

U.S. Pat. No. 5,820,932—Hallman et al (Sun Chemicals), describes a variety of reactive inks and processes.

Methods of inkjet plate making such as that described in U.S. Pat. No. 6,315,916, whereby a pre-sensitized plate has an inkjet image deposited onto it and whereby this image reacts with the sensitized layer, require a subsequent process of development in a processor. Development is a well-known method used with standard pre-sensitized plates, but it is a method which users would like to avoid. It uses highly alkaline liquids, which may have problems of drainage disposal in many countries. The processing liquid is subject to reaction with the air and must be changed every few weeks; also, the processing liquid gradually becomes contaminated with the material it is removing. This often forms sludge and the processor needs to be thoroughly cleaned out periodically. It is no wonder that the industry is seeking out processless plates. Moreover, pre-sensitized plates used in this inkjet method are light sensitive and have to be handled in subdued or yellow light.

Newington et als. (WO 00/37254) and Nitzan et als (WO 01/49506) both use aqueous emulsions as the inkjet fluids. These emulsions have oleophilic particles dispersed in aqueous media and are suitable for ink jetting. On deposition onto the hydrophilic substrate, which is anodized aluminum, the emulsion particles coalesce, forming an insoluble oleophilic image. Such an image can be hardened by heating to increase the adhesion of the image to the plate surface, thus giving a larger number of acceptable printing impressions.

Methods involving the use of uncoated anodized aluminum suffer from the problem of poor surface stability. The surface of uncoated anodized aluminum is oxidized with time and loses its hydrophilic properties. This is well known in the art and in the case of pre-sensitized plates that have been imaged and developed to expose uncoated anodized aluminum in background areas it is necessary to preserve the plate with a layer of gum or gum substitute.

WO Application No PCT/IL03/01032 (incorporated for reference herein) describes the use of a hydrophilic coating on aluminum which does not suffer from the stability problems of anodized aluminum and which can be imaged with an aqueous pigmented inkjet ink containing polymer binder. In order to increase the run length of the plate on the printing press it is heated after imaging to obtain good anchorage of the inkjet ink to the polymer coating and good resistance of the coating to wear and fount attack in unimaged areas. The coating is formulated to ensure that under the conditions of heating it retains its hydrophilic nature. It is possible to over-heat the coating, in which case it becomes oleophilic and unsuitable for use as a printing plate, because the background as well as the image would then take ink.

The dilemma of ink jetting an aqueous based inkjet ink onto a hydrophilic plate surface for use as a printing plate is that the surface needs to be highly hydrophilic in order to take the printing fount solution that keeps the print background clean by repelling the ink from non image areas. As a consequence of this, aqueous inkjet inks tend to spread when they impact surfaces of high surface energy (which is another way of describing hydrophilic surfaces). This hinders the achievement of high resolution for which the ink jet droplets need to be small and spread needs to be minimized.

Although in general the prior art does not deal with this problem, recently the effect has been recognized by inventors who have attempted to address the issue. Nitzan (WO 01/49506) claims better control of dot size by providing for instance a thin cationic surfactant coating on the surface of the anodized aluminum, which received the aqueous inkjet ink. According to this patent the dot size may be reduced from 100 microns diameter to a minimum of 45 to 50 microns. Such coating need not be removed before printing and the plate may be heated up to 200° C. to increase run length. According to this application, the cationic coating does not interfere with performance. The cationic layer as described by Nitzan for improving resolution will not prevent the surface oxidation effect experienced when uncoated aluminum is stored for any length of time.

Aurenty et als in WO 00/76779 are particularly concerned with the problem of increasing the resolution for images produced on offset lithographic plates using inkjet inks. They use surfactants absorbed on the surface of the plates and then desorbed after imaging, either with gum or fount. The application WO 00/46036 is similar.

Aurenty et als and Nitzan are primarily concerned with jetting onto treated aluminum. This permits the surfactant coatings used to promote enhanced resolution to be removed by one means or another after imaging and even after fusing the image at high temperatures. As has been stated above, such aluminum plates tend to show low shelf life with the appearance of scumming due to oxidation.

Attempts to apply methods of enhanced resolution to the coated aluminum inkjet plates described in WO Application No. PCT/IL03/01032 have been unsuccessful. It has been found that after imaging and subsequent fusing, the layers of Nitzan and Aurenty become embedded into the plate coating and cannot be easily removed. Consequently, the background areas, which should receive fount during printing, giving an oleophobic surface so that a clean background is obtained on the printing impressions, continue to be oleophilic and produce bad background scumming.

SUMMARY OF THE INVENTION

It is an objective of the invention to produce an improved resolution for plates based on hydrophilic organic coated substrates, where a hydrophobic layer is present during inkjet imaging and where after heating to fuse the inkjet image, the hydrophobic layer does not irreversibly fuse into the organic coating, but can be removed by aqueous washing to restore the hydrophilic nature of the plate surface.

It is a further objective of the invention to produce image inkjet dots whose dimensions are comparable to those produced by conventional (traditional) offset printing imaging systems.

It is a further objective of the invention to provide methods of removing the hydrophobic layer with little or no extra treatment after imaging and heating, so as to be regarded as close as possible to processless.

Thus, there is provided according to one aspect of the present invention a plate for imaging with an inkjet printer using pigment-based aqueous inkjet ink, comprising: pre-treated aluminum base; a first coating over the base, comprising organic-based polymer, the polymer capable of being dried to a hydrophilic film; and a second coating over the first coating, the second coating deposited from water.

According to one embodiment, the pre-treatment comprises pre-treatment with phosphoric acid.

According to another embodiment, the first coating comprises an aqueous mixture of hydrophobic emulsion, surfactant, aminoplast, polyacrylic acid and polyvinyl alcohol.

According to yet another embodiment, the second coating comprises a mixture of: water-soluble hydrophilic polymer; water-soluble hydroxyl containing organic compound; solid, organic, non-ionic water-soluble and hydrophilic material; and binder resin.

The water-soluble hydroxyl may comprise between 95 and 99 percents parts by weight of the second coating.

The binder resin may comprise 0.5 to 5 percents parts by weight of the second coating.

The solid, organic, non-ionic, water-soluble material may comprise mono, di and tri saccharides.

According to yet another embodiment, the plate additionally comprises biocide.

According to yet another embodiment, the plate additionally comprises a silicone system that exists as an emulsion.

According to yet another embodiment, the plate additionally comprises a third coating, over the second coating, the third coating comprising less than 0.005 grams/square meter of silicone deposited from solvent.

According to a second aspect of the present invention there is provided a process for producing a plate for imaging with an inkjet printer using pigment-based aqueous inkjet ink, comprising the steps of: providing a pre-treated aluminum base; coating the base with a first organic-based polymer coating; heating the first coating to create a dry hydrophilic film therefrom; and coating the dried first coating with a second coating deposited from water.

According to a third aspect of the present invention there is provided a method of reduced dot-size imaging a plate with an inkjet printer, comprising the steps of: producing a plate by using the process according to the second aspect; imaging the plate with the inkjet printer using pigment-based aqueous inkjet ink; heating the imaged plate; and removing the second coating.

According to one embodiment, the step of removing comprises washing the second coating with water.

According to another embodiment, the step of removing comprises treating the second coating with gum.

According to an additional embodiment, the step of removing comprises washing the second coating with fount during printing.

DETAILED DESCRIPTION OF THE INVENTION

For the production of conventional pre-sensitized plates, Aluminum metal is treated by anodizing the surface to a hard oxide and graining the surface to give increased surface area for fount absorption. The aluminum based plates of the present invention are made by pre-treatment of the metal, followed by a coating of an organic based polymer system. For the purposes of this invention, such plates will be referred to as coated aluminum. This system is described in WO Application No. PCT/IL03/01032 where the preferred pre-treatment is with phosphoric acid and the coating is an aqueous mixture of hydrophobic emulsion, surfactant, aminoplast, polyacrylic acid and polyvinyl alcohol. As a second coat will be later referred to in the text, this first coating will be further designated as the primary coating. The primary coating mixture can be dried to a hydrophilic film that is not dissolved up nor worn away by aqueous fount solutions used in the offset lithographic printing process. The blank prepared according to the present invention may be imaged with an inkjet printer using a pigment based aqueous inkjet ink such as those sold for use in the Epson Stylus C82 and sold under the trade name of DuraBrite inks. After imaging, it is preferable to dry the inkjet ink by heating. The heat, after drying by evaporation of water and driving water and humectant into the organic coating, also fuses the remaining components into the organic coating. This helps promote long run-length on the offset lithographic printing press.

Measurement of the dots produced on paper using the finest quality setting for current Epson inkjet printers shows that the dots may be as small as 30 microns. However, on the same inkjet machine settings, using the same ink, measurements of dots on the coated plates show dots of 50 microns.

As has been shown by reference to the prior art, it is possible to affect dot reduction by using surfactants which are hydrophobic. The hydrophobic coating is then removed either by desorbing or in the course of printing. The prior art was primarily concerned with treated aluminum (grained, anodized etc.) rather than coated aluminum such as is the subject of the present invention. As has been pointed out, the use of treated aluminum has drawbacks of shelf life, so the coated aluminum is preferred in this respect. However, solutions of dot reduction that involve the materials described in the prior art have been found to be inapplicable to coated aluminum, where the image is fused into the coating by heat. This is because the heat that is used to fuse the inkjet ink into the coating also fuses the hydrophobic layer used and the plate takes ink in the background areas as well as the image areas.

It is recognized that the use of an over-coat which may be used to reduce inkjet ink spot size by providing a low surface energy on which to image would be advantageous, if it could be removed after the heat fuse stage. However, existing prior art does not provide suitable coatings.

The inventors have discovered suitable coatings with the desired properties. These coatings are herein designated secondary coatings. They are part of the printing plate blank supplied to the customer, onto which he will image with inkjet ink. After imaging, the plate is heated and then the secondary coat removed by either washing with water, or by treatment with gum, or during the printing process by the effect of fount during the initial roll up of the plate on the machine.

It has been found that non-volatile organic compounds for use as a hydrophobic secondary coat top layer using organic solvent as the carrier liquid as opposed to water, gives too much penetration into the primary coating and cannot be subsequently removed.

Surprisingly, it has been found that a mixture of water soluble hydrophilic polymer combined with a water soluble hydroxyl containing organic compound may be coated on top of the primary coating and then gives dot reduction. It is not understood why hydrophilic coatings should have this effect. Whilst not being bound by any theory, it is possible that the continuous nature of the surface film formed by the secondary coat over-layer reduces the capillary travel of the aqueous carrier in the ink compared to the open structure of the primary coat. Such over-coatings must be deposited from water and all ingredients of such coating must be water-soluble. Examples of suitable polymers are hydroxy ethyl cellulose, polyvinyl alcohol and polyvinylpyrolidone, gum Arabic, polyethyl oxazoline, butylated polyvinylpyrolidone, polyethylene oxide, poly(methyl vinyl ether)vinylcaprolactam/dimethylaminopropyly Methyacrylamide/Hydroxyetheyl Methacrylate terpolymer and Vinyl Pyrrolidone/Dimethylamonopropro/Methacrylamide Copolymer.

It has been found that these polymers alone do not give good results. They are not easily removed after imaging and do not give dot size reduction. The second type of material needed for suitable secondary layers must also be organic non-ionic water soluble and hydrophilic and solid. Such materials are also characterized by hydroxyl groups. Thus, it has been found that mono, di and tri saccharides may be combined with the above polymers to function as required. It has been found that such materials do not work by themselves, as they do not reduce dot size. This may be because they need some binder resin to produce the smooth continuous film that gives spot reduction. Generally, the binder needs to be present in parts by weight of between 0.5% and 5%—preferably 2 to 4%. The non-polymeric hydrophilic water soluble organic compound should be present in parts by weight of between 95% and 99.5%, with a preferred range of 96% to 98%. An exceptional material, which is also the preferred one, is from the family of polyethylene glycols whose members have different molecular weights. The lower molecular weight members of this family are liquids and as such are unsuitable. But polyethylene glycol (20,000 molecular weight) is a solid and can be used without another additive.

Where necessary less than 2% by weight of a biocide is added to prevent organic growth on the layer during storage. It has also been found that it is possible to add less than 0.1% of the total solids of a silicone system that exists as an emulsion. More than this in the system cannot be removed by washing.

In a further embodiment, it is possible to coat the secondary coat with a less than 0.005 grams per square meter coating of silicone deposited from solvent.

EXAMPLE I

Primary Coating

The following formulation was made up. Ingredients are quoted in parts by weight and were added in the order shown. After each addition the mixture was high speed stirred to ensure good mixing. The polyvinyl alcohol and polyacrylic acid solutions are aqueous:

| | |
|---|---|
| Polyvinyl Alcohol Solution (12%) | 5.92 parts |
| Polyacrylic Acid (35%) | 12.48 parts |
| Water | 30.00 parts |
| GPRI BKUA-2370 (45%) | 12.08 parts |
| BYK 346 | 0.58 parts |
| Cymel UFR-60 | 0.8 parts |
| Aerosol OT (19.83%) | 3.2 parts |
| Kaolin | 6.25 parts |

150-micron aluminum foil was washed with methyl ethyl ketone and then immersed in phosphoric acid for 4 minutes, then washed with water and dried. The above mixture was ball milled for 3 hours and then coated onto the aluminum foil and dried in the oven at 110° C. for 2 minutes, giving a total dry weight coating thickness of approximately 3.9 grams per square meter.

Secondary Coating

The following solution was made up;

| | |
|---|---|
| Sugar | 7.50 g |
| Water | 33.75 g |
| Natrosol (1% solution) | 24.00 g |

This was bar coated on top of the primary coating described above and oven dried at 110° C. for 2 minutes to give a coating weight of approximately 0.45 gram per square meter.

An Epson Stylus 7600 ink jet printer was used with the standard magenta pigmented ink no T5433. The coated foil prepared above was passed through the printer. The resulting imaged plate was heated to 160° C. for 6 minutes, washed with water and then run as an offset lithographic printing plate on a Heidelberg GTO printing press to give 25,000 clear good impressions.

Measurements of the inkjet dot size before printing were compared to the size of inkjet dots measured when only the primary coating was used. The size was reduced by 50% by the use of this secondary coating.

EXAMPLE II

The primary coating was the same as used in Example I. The following solution was made up for a secondary coating;

| | |
|---|---|
| D-Mannose | 7.5 g |
| Water | 33.75 g |
| Natrosol (1% solution) | 24.00 g |

The mixture was bar coated on top of the primary coating as described above and oven dried at 110° C. for 2 minutes, to give a dry coating weight of approximately 0.45 grams per square meter. Dot size of the inkjet image compared with inkjet dots on the primary coating were reduced by 60%.

EXAMPLE III

The following solution was made up;

| | |
|---|---|
| Polyethylene glycol (Molecular weight 20,000) | 7.5 g |
| Polyethylene oxide | 7.5 g |
| Water | 115.50 g |

The mixture was bar coated on top of the primary coating of Example I as described above, oven dried at 110° C. for 2 minutes to give a dry coating weight of approximately 0.45 grams per square meter and imaged on an Epson 7600. Inkjet ink drops on the plate were 60% of the size compared to those deposited directly onto the primary coating.

Sources of Raw Materials

Cymel UFR-60 methoxymethyl methylol urea (88% solution in isopropanol) Cytec Industries. Five Garret Mountain Plaza, West Patterson, N.J. USA BYK 346. BYK-Chemie GmbH, Postfach 100245, Wesel Aerosil OT. Dioctyl ester of sodium sulfosuccinic acid from BDH Laboratory Supplies, Poole, England.

GPRI BKUA-2370 phenolic resin dispersion Georgia-Pacific, Atlanta Ga., USA

SMD 3405 phenolic resin dispersion. Schenectady Europe, Wolverhampton, UK.

Natrosol HHBR Hydroxyethyl cellulose. Hercules, Wilmington Del., USA.

The invention claimed is:

1. A plate for imaging with an inkjet printer using pigment-based aqueous inkjet ink, comprising:

pre-treated aluminum base;

a first coating over said base, comprising organic-based polymer, said polymer capable of being dried to a hydrophilic film; and a second coating over said first coating, said second coating including a water-soluble hydrophilic polymer;

wherein said first coating comprises an aqueous mixture of hydrophobic emulsion, surfactant, aminoplast, polyacrylic acid and polyvinyl alcohol.

2. The plate according to claim 1, wherein said pre-treatment comprises pre-treatment with phosphoric acid.

3. The plate of claim 1, additionally comprising a third coating, over said second coating, said third coating comprising less than 0.005 grams/square meter of silicone deposited from solvent.

4. A method of reduced dot-size imaging a plate with an inkjet printer, comprising the steps of:

producing the plate of claim 1;

imaging said plate with said inkjet printer using pigment-based aqueous inkjet ink;

heating said imaged plate; and removing said second coating.

5. The method according to claim 4, wherein said step of removing comprises washing said second coating with water.

6. The method according to claim 4, wherein said step of removing comprises treating said second coating with gum.

7. The method according to claim 4, wherein said step of removing comprises washing said second coating with fount during printing.

8. A plate for imaging with an inkjet printer using pigment-based aqueous inkjet ink, comprising:

pre-treated aluminum base;

a first coating over said base, comprising organic-based polymer, said polymer capable of being dried to a hydrophilic film; and a second coating over said first coating, said second coating including a water-soluble hydrophilic polymer;

wherein said second coating comprises a mixture including said water-soluble hydrophilic polymer; and a water-soluble hydroxyl containing organic compound; a solid, organic, non-ionic water-soluble and hydrophilic material; and a binder resin.

9. The plate according to claim 8, wherein said water-soluble hydroxyl comprises between 95 and 99 percents parts by weight of said second coating.

10. The plate according to claim 8, wherein said binder resin comprises 0.5 to 5 percents parts by weight of said second coating.

11. The plate according to claim 8, wherein said solid, organic, non-ionic, water-soluble material comprises mono, di and tri saccharides.

12. The plate of claim 8, wherein said second coating additionally comprises biocide.

13. The plate of claim 8, wherein said second coating additionally comprises a silicone system that exists as an emulsion.

14. A method of reduced dot-size imaging a plate with an inkjet printer, comprising the steps of:

producing the plate of claim 8, imaging said plate with said inkjet printer using pigment-based aqueous inkjet ink;

heating said imaged plate; and removing said second coating.

15. The method according to claim 14, wherein said step of removing comprises washing said second coating with water.

16. The method according to claim 14, wherein said step of removing comprises treating said second coating with gum.

17. The method according to claim 14, wherein said step of removing comprises washing said second coating with fount during printing.

18. A method of reduced dot-size imaging a plate with an inkjet printer, comprising the steps of:

producing a plate by providing a pre-treatment aluminum base; coating said base with a first organic-based polymer coating; heating said first coating to create a dry hydrophilic film therefrom; and coating said dried first coating with a second coating deposited from water and including a water-soluble hydrophilic polymer;

imaging said plate with said inkjet printer using pigment-based aqueous inkjet ink;

heating said imaged plate; and removing said second coating by treating said second coating with gum.

* * * * *